United States Patent [19]

Fujimori et al.

[11] 4,319,351

[45] Mar. 9, 1982

[54] SWITCH STRUCTURE FOR A TIMEPIECE

[75] Inventors: Hiroaki Fujimori; Shoichi Nagao, both of Suwa, Japan

[73] Assignee: Kabushiki Kaisha Suwa Seikosha, Tokyo, Japan

[21] Appl. No.: 127,288

[22] Filed: Mar. 5, 1980

[30] Foreign Application Priority Data

Mar. 6, 1979 [JP] Japan ..... 54/25886

[51] Int. Cl.[3] ..... G04C 9/00; G04B 29/00

[52] U.S. Cl. ..... 368/187; 368/190; 368/321; 368/29

[58] Field of Search ..... 368/34, 80, 84, 185, 368/187, 201, 224, 69, 190, 308, 319-321

[56] References Cited

U.S. PATENT DOCUMENTS 4,095,405 6/1978 Tanaka ..... 368/34

*Primary Examiner*—Vit W. Miska

*Attorney, Agent, or Firm*—Blum, Kaplan, Friedman, Silberman & Beran

[57] ABSTRACT

A switch structure for an electronic timepiece including a multi-position external operational member is provided. The structure includes a click lever and a switch lever, each operationally engaged with the external operational member. Rotation of the external operational member pivots the switch lever for making a first switching connection. Axial displacement of the external operational member shifts the switch lever for making a second switching action upon operation of the external operational member. In a digital electronic timepiece including the switch structure, adjustment of time may be made when the click lever is in a first position and a calendar adjustment may be made once the click lever is in a second position.

15 Claims, 12 Drawing Figures

FIG. 5
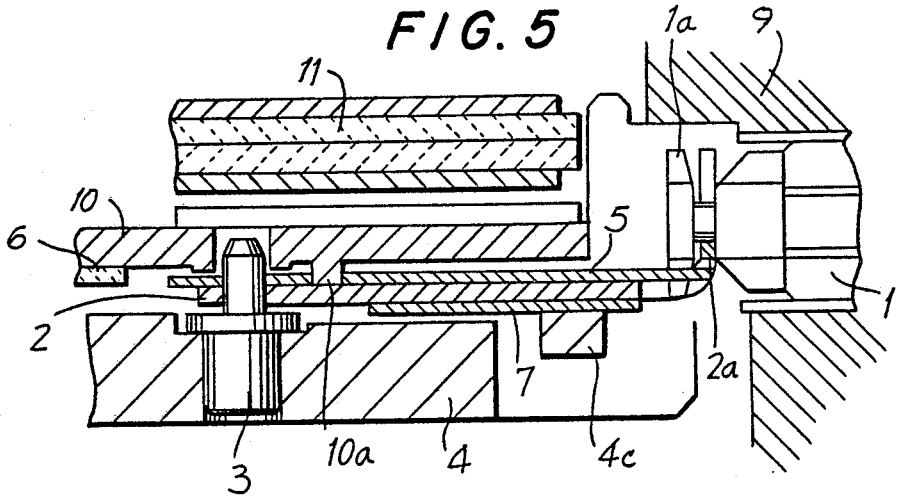
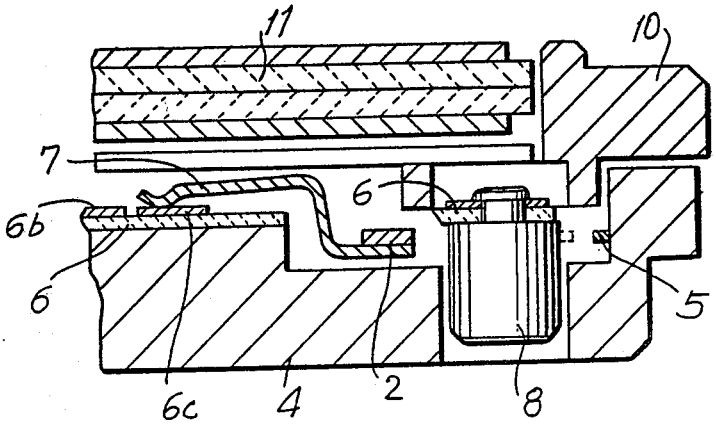
FIG. 6

FIG. 7
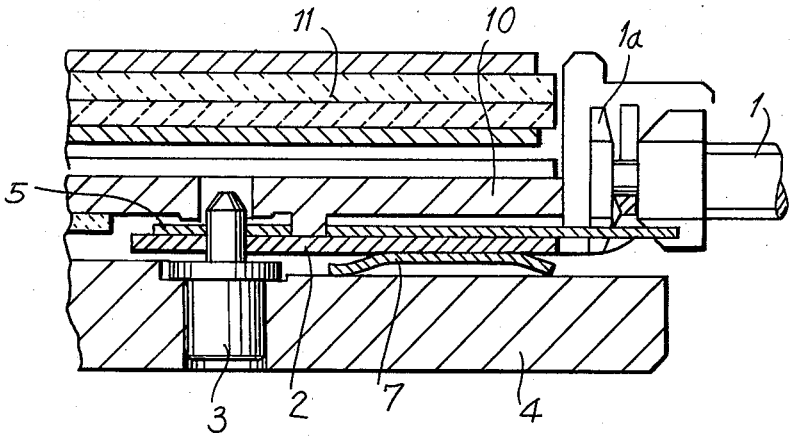
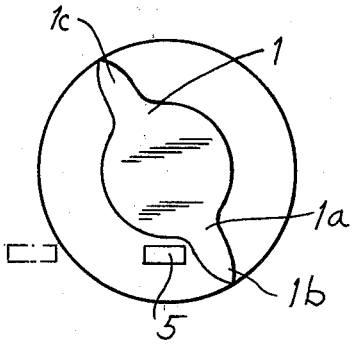
FIG. 8

SWITCH STRUCTURE FOR A TIMEPIECE

BACKGROUND OF THE INVENTION

This invention relates to a switch structure for an electronic timepiece, and in particular to a digital display electronic timepiece including a single operational member for making at least two switching actions in at least two different time display modes.

The number and availability of liquid crystal display electronic timepieces is increasing rapidly. These timepieces share the market with quartz crystal electronic timepieces having analog displays. With the ever increasing number of functions of the liquid crystal display timepieces, operation has become much more complicated. In order to operate the various functions, push buttons are utilized. In many cases, three or four operational buttons need to be provided.

It is only a relatively short period of time since the liquid crystal display timepieces have been introduced in the marketplace. Many people have not been attracted to these timepieces because the operation is quite different from the analog displays which have been the conventional type of timepiece. Thus, many potential wearers feel uneasy because they do not know how to operate the liquid crystal display timepiece having only a single function.

Accordingly, it would be desirable to provide a simplified and miniaturized structure of a change-over switch utilizing the conventional crown which could be incorporated into a small-size timepiece, such as a ladies wristwatch.

SUMMARY OF THE INVENTION

Generally speaking, in accordance with the invention, a switch structure for an electronic timepiece including a multi-positioned external operational member is provided. The operational member is of the winding stem configuration and may be operated by rotation of the stem and may be displaced to a second operational position by displacing in the axial direction. The structure also includes a click lever and a switch lever, each operationally engaged with the winding stem. The click lever is normally engaged in a first operational position and upon rotation of the winding stem, the switch lever engages the contact pin for completing a switching action. This switching action may change-over the display from a display of actual time to a calendar display. By displacement of the winding stem in the axial direction, the click lever is engaged into a second operational position. This second operational position of a click lever and switch lever places the timepiece in a correction mode. Rotation in a clockwise direction indexes the timepiece counters by one each time the switching action is completed and counterclockwise operation subtracts one. Correction in the second timepiece mode is made by displacing the winding stem when the timepiece is in that display mode.

Accordingly, it is an object of the invention to provide an improved switch structure for an electronic timepiece.

Another object of the invention is to provide an improved switch structure for an electronic timepiece of simplified construction which may be readily miniaturized.

A further object of the invention is to provide an improved change-over switch which can be incorporated into a small-size electronic timepiece.

Still another object of the invention is to provide an improved change-over switch for a digital display electronic timepiece utilizing a winding stem.

Still a further object of the invention is to provide an improved change-over switch for an electronic timepiece for permitting change-over between display modes and correction in each display mode without using any operational buttons.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a change-over view of the cross-over switch assembly in the position illustrated in FIG. 4;

FIG. 6 is a cross-sectional view of a portion of the change-over switch assembly in the position illustrated in FIG. 4;

FIG. 7 is a cross-sectional view of a change-over switch construction in accordance with another embodiment of the invention;

FIG. 8 is an elevational view illustrating the engagement relationship between the cam of the winding stem and the switch lever in the change-over switch construction in accordance with the invention;

DESCRIPTION OF THE PREFERRED EMBODIMENTS

Figure 1:
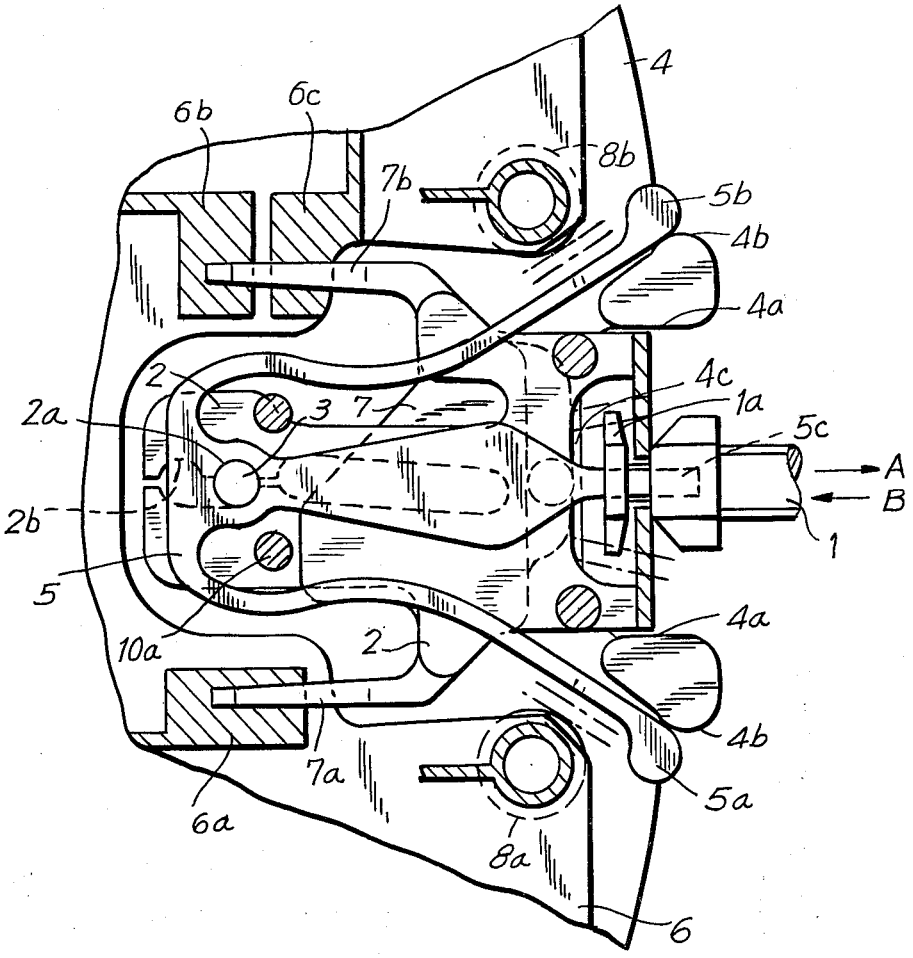
FIG. 1 is a plan view of a change-over switch constructed and arranged in accordance with the invention.

Referring to FIG. 1, a plan view of a change-over switch structure for an electronic timepiece constructed and arranged in accordance with the invention is shown. The timepiece has an external watch case 9 illustrated in FIG. 5. The change-over switch includes a stem 1 which extends to a crown outside of watch case 9 and is operatively connected to circuit elements internally as will be described in greater detail below.

The change-over switch structure is mounted on a circuit case 4 of the wristwatch. A circuit board 6 having various regions of the electrode patterns 6*a*, 6*b* and 6*c* is disposed on circuit case 4. Operation of the change-over switch permits electrical connection and switching action between the various electrode patterns for operation of the timepiece.

The switch structure includes a cam 1*a* mounted on stem 1 inside of watch case 9 for selective operational engagement with a switch lever 5. A click lever 2 having a first click region 2*a* and a second click region 2*b* for engagement with a click pin 3 for fixing the position of click lever 2 when stem 1 is displaced in an axial direction as will be described in more detail below. Click lever 2 also includes a first electrically conductive resilient finger 7*a* for contacting electrode pattern 6*a* and a second electrically conductive resilient finger 7*b* for making electrical contact with electrode pattern region 6*b* or region 6*c* when click lever is displaced to its second click position in click region 2*b*.

Circuit case 4 includes a resilient member 4*c* in a first recess region 4*a* for permitting displacement of click lever 2. A second recess region 4*b* forms a stop for resilient contact arms 5*a* and 5*b* which are oscillated to contact with a first switch pin 8*a* and a second switch pin 8*b* as will be described in more detail below. A frame 10 having projections 10*a* is disposed over switch lever 5.

During operation of change-over switch, click lever 2 engages stem 1 in recess 4*a* formed by machining of circuit case 4. Click pin 3 is fixed in circuit case 4 in recess 4*a* with click region 2*a* engaging click pin 3. When stem 1*a* is rotated, cam 1 engages a central arm 5*c* of switch lever 5 thereby pivoting switch lever 5 about click pin 3. When switch lever 5 is pivoted, one of resilient contact arms 5*a* and 5*b* engage with stop region of recess 4*b* and one of resilient contact arms 5*a* and 5*b* engage one of switch pins 8*a* and 8*b*. During operation in this manner, electrically conductive resilient fingers 7*a* and 7*b* on click lever 2 are in contact with electrode patterns 6*a* and 6*b*, respectively.

Figure 4:
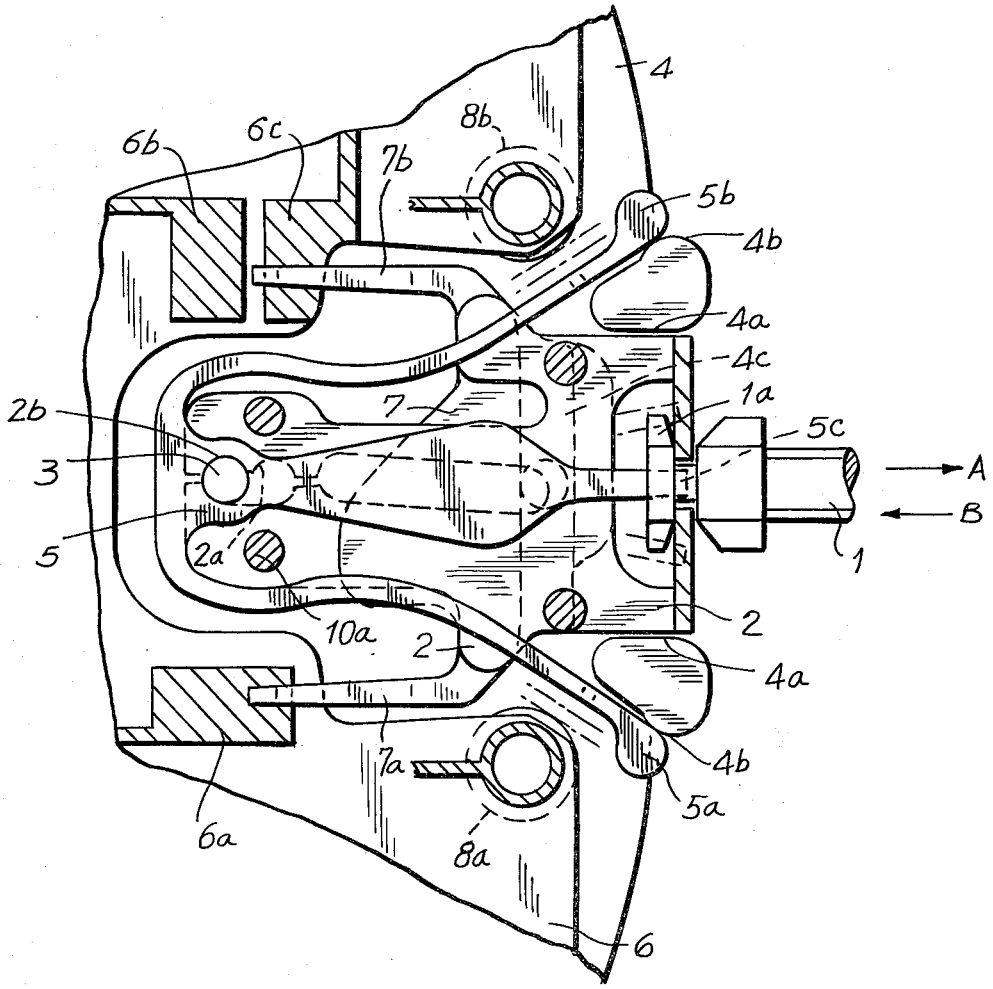
FIG. 4 is a plan view of the change-over switch assembly of FIG. 1 in a second operational mode position.

When a timepiece including a the change-over switch assembly in accordance with the invention is in a normal mode, stem 1 is in its first position as illustrated in FIG. 1. Displacement of winding stem 1 to its second position in the axial direction indicated by arrow A will place the change-over switch in the configuration as illustrated in FIG. 4. The elements are the same as illustrated in FIG. 1 and have been labeled accordingly.

Figure 9:
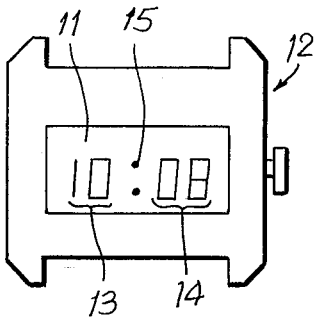
FIG. 9 is a plan view of an electronic timepiece constructed and arranged in accordance with the invention in a display mode displaying actual time.

When the timepiece is in the normal display state as shown in FIG. 1, a timepiece 12 as illustrated in FIG. 9 includes a display of hour 13 and minutes 14 on a display panel 11. A colon 15 is displayed between hours 13 and minutes 14 in order to indicate to a wearer that the timepiece is in the usual time display mode with stem 1 in its first position. When stem 1 is rotated in a clockwise direction cam 1*a* is also rotated clockwise. Cam 1*a* included in the embodiment illustrated herein includes a first camming region 1*b* in an opposed camming region 1*c* as illustrated in FIG. 8. When cam 1*a* is rotated, cam regions 1*b* or 1*c* engage central arm 1*c* of switch lever 5 thereby pivoting switch lever 5 about click pin 3. In response to this clockwise rotation of stem 1, resilient contact arm 5*a* of switch lever 5 engages switch pin 8*a* mounted in circuit board 6. As a result of this electrical contact, the time display of display panel 11 as shown in FIG. 9 is changed-over to a calendar display 11*a* showing a month display 16 and a date display 17.

As noted above, when stem 1 is rotated in a clockwise direction, cam 1*b* engages central arm 5*c* of switch lever 5 thereby pivoting switch lever 5 about click pin 3 so that resilient contact arm 5*a* engages switch pin 8*a*. At this time, a second resilient contact arm 5*b* is biased against rest stop 4*b*. At this time both resilient contact arms 5*a* and 5*b* are in a biased position and are bent.

When stem 1 is further rotated clockwise, cam 1*a* and central arm 5*c* disengage from each other. Due to the biasing of first resilient contact arm 5*a* and second resilient contact arm 5*b*, switch lever 5 returns to its original at rest position as illustrated in FIG. 1. As cam 1*a* is provided with teeth 1*b* and 1*c* when cam 1*a* makes one complete rotation, first resilient contact arm 5*a* of switch lever 5 touches switch pin 8*a* twice thereby displaying calendar display 11*a* of the pin twice.

Figure 10:
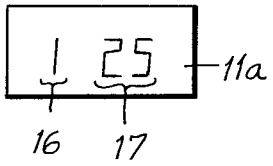
FIG. 10 is a plan view of the display panel of the wristwatch of FIG. 9 in a display mode of month and day.

When stem 1 is turned in a counterclockwise direction, operation of timepiece 12 remains the same as that described above wherein winding stem is turned in a clockwise direction. For example, when stem 1 is rotated in a counterclockwise direction, switch lever 5 is pivoted about click pin 3 in the same direction. At this time, second resilient contact arm 5*b* contacts second switch pin 8*b* and first resilient contact arm 5*a* is biased against rest 4*b*. As a result of the electrical contact between second resilient contact arm 5*b* and switch pin 8*b*, the display of liquid crystal display panel 11 changes over from the display of actual time of FIG. 9 to the month and date display 11*a* of FIG. 10.

If stem 1 is further rotated in the counterclockwise direction, cam tooth 1*c* and central arm 5*c* of switch lever 5 disengage from each other and switch lever 5 returns to its at rest position. When stem 1 is yet further rotated in a counterclockwise direction, second resilient contact arm 5*b* again contacts switch pin 8*b* and the display of liquid crystal display panel 11 is changed-over to display month and the date display 11*a* of FIG. 10. Upon disengagement of cam 1*a* and central arm 5*c*, liquid crystal display panel 11 alternates between display of actual time as illustrated in FIG. 9 and the month and date display of FIG. 10.

Referring now to FIG. 4, when stem 1 is displayed axially in direction A the timepiece is placed in a correction mode. At this time, electrical contact between second conductive resilient finger 7*b* is changed from electric pattern 6*b* to pattern 6*c*. The counters (not shown) of the timepiece are now unlocked. Click lever 2 which is engaged with stem 1 is also displaced in direction A until a click region 2*b* engages click pin 3. This engagement fixes the position of stem 1 in its second switching position. Click regions 2*a* and 2*b* are biased towards click pin 3 so that when stem 1 is placed in its second position, a clicking sound is generated and the engagement can be felt by the user.

As noted above, click lever 2 has first resilient finger 7*a* and second resilient finger 7*b* of resilient member 7 mounted thereon. When stem 1 is in its first normal wearing position first resilient finger 7*a* is in contact with electrode pattern 6*a* which is the plus terminal. In this normal display state of the timepiece, resilient finger 7*b* is in contact with electrode pattern 6*b* and not in contact with electrode 6*c*.

When winding stem 1 is displaced axially in direction A and click lever 2 is similarly displaced, resilient member 7 mounted on click lever 2 is also displaced in direction A. This displacement of resilient member 7 changes the contact of second resilient finger 7b from electrode pattern 6b to electrode pattern 6c. At this time the plus terminal of electrode pattern 6a is connected with electrode pattern 6c through resilient member 7 thereby switching the timepiece into the correction mode. When in the correction mode, colon 15 between hour display 13 and minute 14 in FIG. 9 is displayed continuously. In the normal time display of FIG. 9, colon 15 is normally in a flickering state. At this time the seconds are reset and the timepiece stops. This is the same phenomeon which occurs when the winding stem is pulled out in an analog quartz crystal timepiece.

Figure 11:
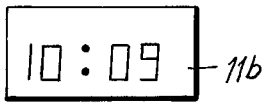
FIG. 11 is a plan view of the display of the timepiece of FIG. 9 illustrating the result of operating the switch lever for adjusting the time display.
Figure 12:
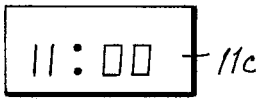
FIG. 12 is a plan view of the display panel of the wristwatch of FIG. 9 illustrating adjustment of the hour display by operation of the change-over switch construction in accordance with the invention.

When stem 1 is in its second position, hour display 13 and minute 14 are corrected by rotation of stem 1. If stem 1 is rotated in a clockwise direction, cam 1a engages central arm 5c of switch lever 5 and switch lever 5 is pivoted about click pin 3. At this time first resilient contact arm 5a is displaced towards first switch pin 8a thereby activating correction of the display of panel 11 from hour display 13 and minute display 14 of FIG. 9 to display 11b of FIG. 11. As illustrated, by rotating stem 1 in a clockwise direction, minute display 14 is indexed by addition of one. Continued indexing occurs upon rotation of winding stem 1 in a clockwise direction until hour display 13 is corrected as illustrated in display 11c of FIG. 12.

In a similar manner, when stem 1 is rotated in a counterclockwise direction, minute display 14 is corrected by subtraction of one each time switch lever 5 is pivoted about click pin 3. When stem 1 is rotated in the counterclockwise direction second resilient arm 5b contacts second switch pin 8b. Operation of the change-over switch in this correction mode when stem 1 is in its second position is quite similar to operation of the switch when stem 1 is in its normal position as illustrated in FIG. 1.

When correction of the timepiece is completed, click lever 2 is returned to its first position engaging click pin 3 at click position 2a by pushing stem 1 to its first position in arrow direction B. When click lever 2 is displaced to the first position, second resilient finger 7b is switched from contact with electrode pattern 6c of circuit board 6 to contact with electrode pattern 6b. At this time the timepiece is returned to the normal time display mode and the timepiece begins to operate.

Correction of month display 16 and date display 17 is performed in the same manner as correction of hour display 13 and minute display 14. The timepiece display is changed-over to calendar display 11a of FIG. 6 by rotating winding stem 1 in its first position with click portion 2a engaging click pin 3 and then winding stem 1 is displaced axially to its second position in direction A. At this time, month display 16 and date display 17 are in a correction mode. Correction of display 11a is by adding or subtracting on as stem 1 is rotated in a clockwise or counterclockwise direction, respectively. This operation is performed in the same manner as correction of time display 11 as described in detail above.

Figure 2:
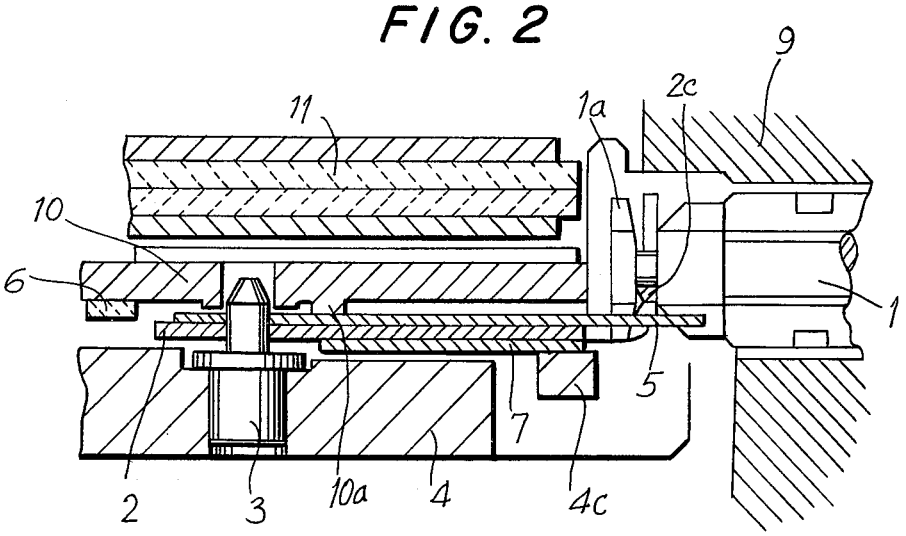
FIG. 2 is a sectional view of the change-over switch assembly depicted in FIG. 1.
Figure 3:
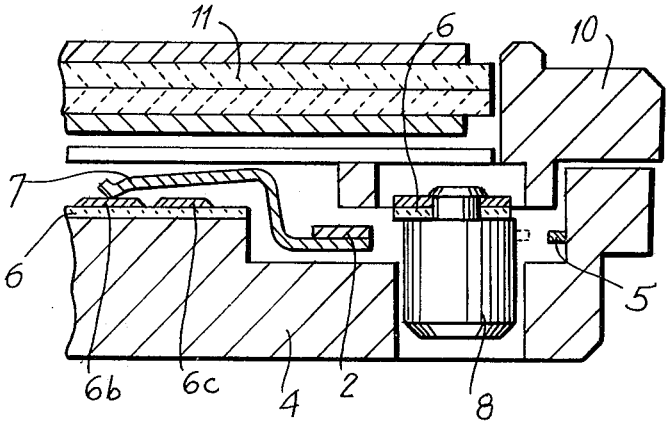
FIG. 3 is a further cross-sectional view of a region of the change-over switch construction illustrated in FIG. 1.

Referring now to FIG. 2, it can be seen that stem 1 is guided only by an opening 9a in watch case 9. Thus, stem 1 is easily shifted vertically within the timepiece resulting in uneven engagement between cam 1a on stem 1 and central arm 5c of switch lever 5. In such a case there is a risk that the pivoting stroke of switch lever 5 will vary. In order to eliminate such a disadvantage, click lever 2 is biased upwardly by a resilient member 4c mounted on circuit case 4 so that contact portion 2c of click lever 2 contacts stem 1. When click lever 2 is biased upwardly by resilient member 4c of circuit case 4, switch lever 5 positioned between panel frame 10 and click lever 2 will not be displaced. Accordingly, projection 10a having a length greater than thickness of switch lever 5 is included on panel frame 10 to insure that switch lever 5 is freely rotatably about click pins.

Referring now to FIG. 7, a change-over switch constructed in accordance with another embodiment of the invention is shown. In this construction, click lever 2 and stem 1 are positioned by resilient member 7 mounted on click lever 2. The configuration of click lever 2 and switch lever 5 conform to the embodiment illustrated in FIGS. 1–6.

Accordingly, by constructing and arranging a change-over switch in accordance with the invention, all the switching functions of a digital display electronic wristwatch having at least two display modes may be operated by an external crown coupled to a stem which is engaged with a switch lever for making electrical contact and a click lever for unlocking the timepiece counters. Thus, the timepiece construction may be simplified and miniaturized. In view of the relatively simple structure, a change-over switch may be readily assembled.

In the construction in accordance with the invention, the engagement portion of the switch lever with the stem and the engagement portion of the click pin with the stem are merely in the same plane. Thus, only a small space is needed and the stem may be shortened. Thus, the timepiece need not be enlarged to receive the switch construction. Additionally, the display area of the liquid crystal display panel need not be reduced in a given watch case size even if the winding stem is positioned on the side of the panel in a conventional manner. As the click pin for the click lever also serves as the shaft about which the switch lever is pivoted, the number of parts is not increased and space is efficiently utilized. In addition, the circuit case and the panel frame are used as means for stabilizing the engagement between the cam of the winding stem and the switch lever. Thus, the number of parts is again not increased and the cost of the assembly is not raised.

In the construction illustrated herein, the number of cam teeth of the cam on the winding stem is two. It is clearly within the scope of the invention that the cam may be provided with additional teeth. Preferably, the cam would include two or four teeth in order to permit some rotation before contacting the switch lever with the switch pin.

As mentioned above, in the construction in accordance with the invention, the complicated button operations of the conventional liquid crystal timepieces is avoided. The manner in which the crown or stem is pulled out and turned is much the same manner as an analog display timepiece which most users are fully accustomed. Thus, a small-size change-over switch structure which can be easily utilized by people not familiar with the button operation and which can be incorporated into a small-size electronic timepiece, such a ladies watch is provided by the invention.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A switch structure for an electronic timepiece having a substantially planar substrate and circuit means mounted thereon for performing measurement of actual time and at least one additional timekeeping function and display means for displaying the results of one of the timekeeping functions at a time, comprising an external operational member displaceable in at least two directions for completion of switching operations for changing-over the display means from the display of the one-timekeeping function to the display of the other timekeeping function and for placing the circuit means in a different operational mode, said external operational member operationally engaged to first switch means including a substantially planar click lever activated by displacement of said external operational member axially from a first position to a second position and second switch means including a second substantially planar switch lever selectively engageable with said external operational member when said member is rotated, said second lever being displaceable in a plane substrate parallel to the substrate said second lever having a central arm selectively pivotable by rotation of said external operating member and two elastic contact arms which extend on both sides of said central arm, said second switch means further including stopper means for controlling the displacement of the elastic contact arms in one direction of displacement and electrical contact means, one elastic contact arm operating as a bias for returning the other elastic contact arm to its starting position following a switching operation.

2. The switch structure of claim 1, wherein said different operational mode is a timepiece correction mode.

3. The switch structure of claim 1, wherein said timepiece further includes a circuit board having a plurality of electrode patterns disposed thereon, said first click lever includes a central arm engaged to the external operational member and two electrically conductive wing portions extending from said central arm, said wing portions electrically engaged with at least two portions of said electrode patterns when said click lever is in its first normal position and in contact with one of said patterns and another pattern when displaced in the axial direction to its second position in response to the axial displacement of said external operational member.

4. The switch structure of claim 1, wherein said external operational member is in the form of a watch stem having a cam member thereon, said cam selectively engageable with said second switch lever for pivoting said switch lever for completion of a switching operation.

5. The switch structure of claim 1, further including a fixedly mounted click pin, said click lever resiliently engaging said pin in the first axial position and at a second position when said external operational member is displaced axially between its first and axial second positions.

6. The switch structure of claim 4 wherein said cam includes two opposed cam teeth for operative engagement with said switch lever for completion of the switching operation when said winding stem is rotated.

7. The switch structure of claim 4, wherein said cam includes four cam teeth for contacting said switch lever for completion of the switching operation when said winding stem is rotated.

8. The switch structure of claim 1, further including biasing means for biasing said click lever into engagement with external operation member.

9. The switch structure of claim 1, further including a frame overlying said levers, said switch lever disposed between said frame and said click lever with the distance between said frame and said click lever greater than the thickness of said switch lever thereby permitting free pivoting of said switch lever and return to its at rest position.

10. The switch structure of claim 3, wherein the second timekeeping function of said circuit means is month and date.

11. The switch structure of claim 1, wherein said display means includes a liquid crystal display cell.

12. The switch structure of claim 1, wherein displacement of said first click lever in an axial direction places the circuit means into the different operational mode.

13. The switch structure of claim 1, wherein rotation of said second switch lever changes-over the display means from a display of actual time to a display of the additional timekeeping function.

14. An electronic timepiece having a substantially planar substrate and circuit means mounted thereon for performing measurement of actual time and at least one additional timekeeping functions and display means for displaying one of the functions at a time, the improvement which comprises an external operational member displaceable in at least two directions for completion of a switching operation for changing-over the display means from display of the first timekeeping function to the display of the second timekeeping function and for placing said circuit means in a correction mode when displaying either of the timekeeping functions, a substantially planar click lever engaged with said external operational member and displaceable from a first position in contact with said circuit means to a second position in differing contact with said circuit means for placing said circuit in the correction mode, said click lever displaceable between a first at rest position and a second position when said external operational member is displaced in the axial direction, and a substantially planar switch lever displaceable along a plane substantially parallel to the substrate between a first at rest position with said display of actual time in said display means and a second position for change-over of the display to a display the additional timekeeping function in response to rotation of said external operational member.

15. The timepiece of claim 14, wherein said display of the additional timekeeping function is placed in a correction mode by displacing said click lever to its second position when said switch lever is rotated to its second position to change-over the display to the display of the additional timekeeping function.

* * * * *